United States Patent [19]

Hoover, Jr.

[11] 3,995,430

[45] Dec. 7, 1976

[54] VALVE NOISE SUPPRESSION BY FLUID RECIRCULATION

[75] Inventor: Delmer Q. Hoover, Jr., Pittsburgh, Pa.

[73] Assignee: Westinghouse Electric Corporation, Pittsburgh, Pa.

[22] Filed: Mar. 28, 1975

[21] Appl. No.: 563,422

[52] U.S. Cl. ..... 60/657; 137/560; 251/319; 137/563

[51] Int. Cl.[2] ..... F01B 31/00

[58] Field of Search ..... 137/560; 251/319; 60/657, 660; 91/416

[56] References Cited

UNITED STATES PATENTS 623,935 4/1899 Wilson et al. ..... 137/560

*Primary Examiner*—Harold W. Weakley
*Attorney, Agent, or Firm*—G. H. Telfer

[57] ABSTRACT

A flow control apparatus having a noise and vibration suppression arrangement associated therewith. A suitable piping arrangement permits introduction of a pressurized fluid into a chamber above a valve plug movably disposed within the casing of the flow control apparatus. The fluid is conducted into the plug chamber from a region having a pressure therein higher than the pressure immediately beneath the valve plug and passes from the plug chamber to mix with the high velocity inlet flow entering the flow control apparatus to dissipate the energy associated with the influent flow and to prevent excessive noise and vibration levels within the flow control apparatus.

7 Claims, 5 Drawing Figures

VALVE NOISE SUPPRESSION BY FLUID RECIRCULATION

BACKGROUND OF THE INVENTION

1. Field of the Invention

This invention relates to flow control apparatus and in particular, to a flow control apparatus having a noise and vibration suppression arrangement associated therewith.

2. Description of the Prior Art

In general, a steam turbine power plant, whether fossil or nuclear, comprises a series-connected arrangement of a steam generator element, turbine element, and a condenser element. It is, of course, well known that the turbine element converts the energy contained within a high pressure and high temperature motive fluid, commonly steam, into rotational mechanical energy. The rotational mechanical energy is transmitted by a common shaft to an associated electrical generator element which provides electrical energy to an electrical load. Suitable flow control apparatus, including at least one control valve, is connected within the conduit arrangement between the steam generator and the turbine elements.

The control valve, in addition to providing steam interdiction capability in the event of system malfunction, has as its function the regulation of the steam flow from the steam generator element into the turbine element. The steam conducted into the turbine element enters through an admission arc which is located within the turbine immediately preceding the first array of stationary blade elements mounted within the turbine casing. It is the practice in the art to provide, for certain turbine constructions, a plurality of admission arcs and, for this reason, such turbines are said to have a plurality of partial admission arcs therein. If a turbine is provided with such a plurality of partial admission arcs, there is a control valve disposed in the steam line between each admission arc and the steam generator element.

When low load conditions are imposed upon the generating system, usually during off-peak periods, it is common practice to reduce the mass flow of motive fluid to the turbine. To accomplish this reduction in mass flow to the turbine, the position of a valve plug within the control valve is modulated relative to its valve seat. Such modulation reduces the pressure of the motive fluid entering the turbine, and since, in single admission arc turbines, the admission area of the turbine remains constant, the mass flow rate entering the turbine is reduced. Of course, if a turbine having a plurality of partial admission arcs is utilized, reduction of mass flow rate is accomplished by sequentially reducing the area available to the flow; that is, utilizing only a predetermined number of the admission arcs available. Furhter, the pressure of the motive fluid entering each partial admission arc is regulated by modulating the position of the control valve plug associated with and governing the flow into each admission arc.

It has been observed in some valve constructions that, for a given valve plug position, the pressure ratio between the static pressure at the valve inlet and the static pressure at the inlet of the turbine is lower than a predetermined value, the fluid streams entering the outlet conduit beneath the value plug flow along the conduit boundaries and do not separate therefrom. It has also been observed for such a flow pattern that a gradual increase in the static pressure occurs within the outlet conduit for approximately five pipe diameters downstream of the valve plug. The increase in the static pressure downstream from the control valve creates a pressure in the outlet conduit downstream of the valve plug that is greater than the static pressure immediately underneath the valve plug. Thus, for low valve-inlet-to-turbine pressure, ratios the static pressure downstream of the valve plug is greater than the static pressure immediately underneath the valve plug. A back flow of fluid in the outlet piping is thereby produced. This back flow has the advantageous effect of dissipating the velocity of the inlet flow stream. Although the interaction of the recirculated back flow and the high velocity inlet stream causes some shear noise, for lower inlet pressure ratios these effects are not deleterious.

It has been found, however, that during low load conditions, the ratio of valve inlet pressure to turbine inlet pressure for a given valve plug position exceeds the predetermined value. During such a condition, it has been observed that excessive noise and vibration levels occur within the control valve. Such excessive noise and vibration levels are thought to be generated by the impingement of the high velocity motive fluid streams beneath the valve plug adjacent to the valve outlet.

The fluid streams enter the channel defined between the valve plug and valve seat at such a high velocity that separation from the boundary walls of the outlet conduit occurs, and fluid streams entering from opposite sides of the valve plug impinge beneath the plug. The impingement of the fluid streams generates closed vortex immediately beneath the valve plug. Fluid trapped within the vortex exerts time varying forces against the underside of the plug, which cause excessive vibration within the valve. In addition, the collision of the influent streams generates an excessive noise level within the valve.

As a result of the flow on the axis of the outlet conduit, the natural back flow of recirculating fluid (which occurs for lower pressure ratios) is blocked and forced to the outer walls of the outlet conduit. Thus, for the higher valve-inlet-to-turbine pressure ratios which occur during low load conditions, viscous interaction between the influent flow streams and the recirculating back flow is reduced greatly.

It is apparent that the noise and vibration induced by the impingement of the inlet flow stream must be controlled in order to prevent possible damage to the valve itself and to the associated conduits. In addition, operating noise levels must meet recently promulgated safety standards. It is therefore imperative, both from an operational and an environmental standpoint, that the noise and vibration levels presently being generated be abated.

The prior art has attempted to suppress the noise and vibration within the control valve by a variety of methods. One method disposed an annular muffler circumferentially about the valve plug. The muffler has extending therethrough a plurality of small bores. The muffler is disposed within a predetermined close clearance of the valve plug such that any influent flow stream entering the channel defined between the valve plug and the valve seat is required to pass through the plurality of openings. It is anticipated that fluid friction between the walls of the bores in the muffler and the influent fluid stream can sufficiently dissipate the velocity of the motive fluid to prevent the influent streams from colliding beneath the valve plug. However, it is empirically found that it is impossible to provide a sufficient number of muffler bores having a sufficiently small diameter in order to effectively dissipate the velocity head of the influent motive fluid stream.

As an alternative, the turbine power plant may be operated in a mode such that the ratio of input pressure of the valve relative to the input pressure of the turbine is kept below the predetermined value so that the above-described impingement of the inlet flow streams does not occur. However, maintaining the inlet pressure ratio below this predetermined threshold has a deleterious effect upon the operating efficiency of the entire system.

It can therefore be appreciated that a flow control apparatus having a noise and vibration suppression arrangement associated therewith to inhibit the noise and vibrational levels currently being generated within the control valves presently utilized must be provided.

SUMMARY OF THE INVENTION

This invention discloses a flow control apparatus disposed in a steam turbine power plant, the flow control apparatus having a noise and vibration suppression arrangement associated therewith. The flow control apparatus comprises a casing member having mounted for reciprocal movement therein a valve plug member. The plug has an internal cavity defined on the interior thereof, the internal cavity communicating with that volume of the valve immediately beneath the plug through a substantially axial bore provided in the base of the plug. An external piping arrangement provides an independent path whereby fluid can flow from downstream of the valve plug to the internal cavity therein when the static pressure downstream of the plug is higher than the pressure immediately beneath the plug. The higher pressure fluid passes from the internal plug chamber through the axial bore in the plug base to intermix with the fluid flow passing immediately beneath the valve plug to dissipate the energy associated with this fluid flow to reduce the noise and vibration levels, within the flow control apparatus.

It is an object of this invention to provide a flow control apparatus having a noise and vibration suppression arrangement therewith. It is a further object of this invention to provide a flow control apparatus having conduit means for permitting the reintroduction and recirculation of motive fluid through a chamber above the valve plug into the conduit immediately downstream of the valve plug to cause viscous interaction between the recirculated fluid and the high velocity inlet fluid to suppress noise and vibration energies generated within the flow control apparatus. Other objects of this invention will be made clear in the following description of the preferred embodiment described herein.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 4:
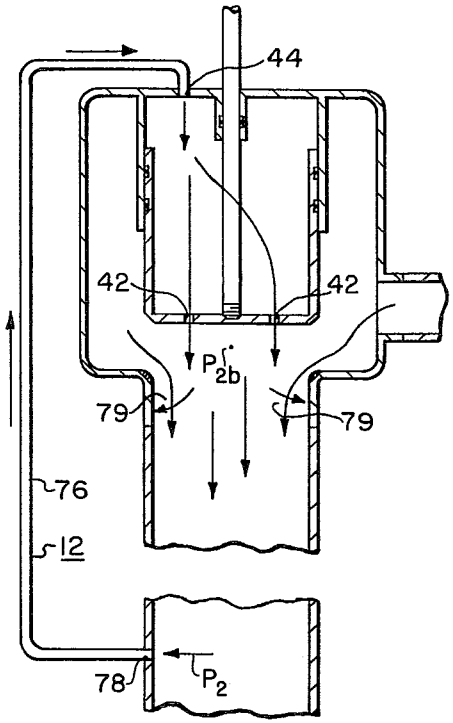
FIG. 4 is a diagrammatic view illustrating the operating principle of a flow control apparatus embodying the teachings of this invention.

Throughout the following description similar reference characters refer to similar elements in all Figures of the drawings.

Figure 1:
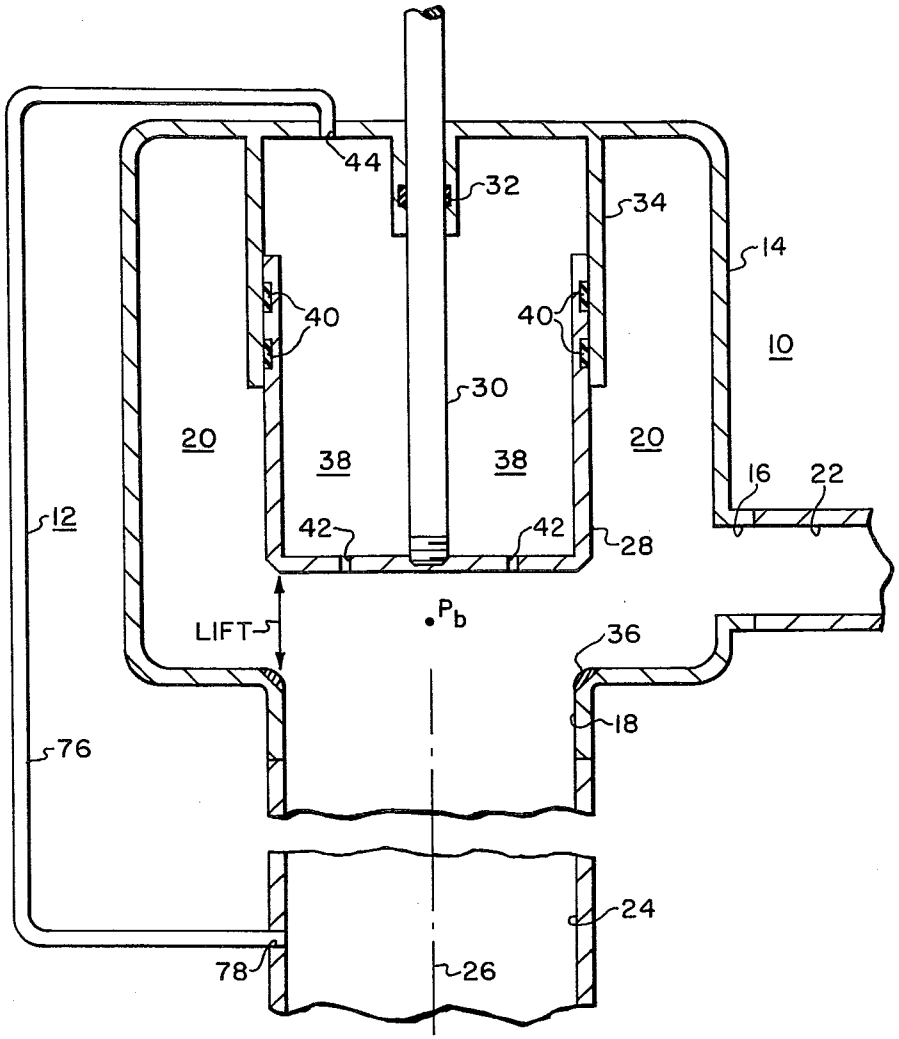
FIG. 1 is an elevational view entirely in section of a flow control apparatus having a noise and vibration suppression arrangement associated therewith embodying the teachings of this invention.

Referring first to FIG. 1, an elevational view, entirely in section, of a flow control apparatus 10 having a noise and vibration suppression arrangement generally indicated at reference numeral 12 and embodying the teachings of this invention is shown. The flow control apparatus 10 comprises a valve housing 14 having an inlet port 16, an outlet port 18, and an annular valve chamber 20 defined therein. The inlet port 16 is connected to an inlet conduit 22, while the outlet port 18 is connected to an outlet conduit 24 having an axis 26 therethrough.

Movably disposed for reciprocal movement within the housing 14 is a plug member 28 securely attached to a valve shaft 30. The shaft 30 extends through the housing 14 to engage an external actuator (not shown). Seal members 32 are provided to insure a leak proof passage for the shaft 30 out of the housing 14. A substantially cylindrical plug guide member 34 is provided on the interior of the housing 14 and serves to guide the plug 28 toward a valve seat 36 disposed circumferentially about the outlet port 18 within the housing 14. When abutting relationship is established between the plug 28 and the seat 36, the inlet port 16 is completely isolated from the outlet 18 and passage of any fluid therebetween is prohibited.

As seen in FIG. 1, the plug 28 is a substantially cup-shaped member defining a hollow central cavity 38 therein. Seals 40 are provided between the sidewalls of the plug 28 and the plug guide 34 to prevent communication between the valve chamber 20 and the central cavity 38 of the valve plug 28. According to the teachings of this invention, an array of openings 42 are provided in the bottom of the plug 28 to equalize the pressure inside the cavity 38 and beneath the plug 28 and also for reasons that will become more apparent herein. Extending through the top cover of the valve casing 14 is an opening 44, the opening 44 communicating with the central cavity 38 of the plug 28.

Figure 2:
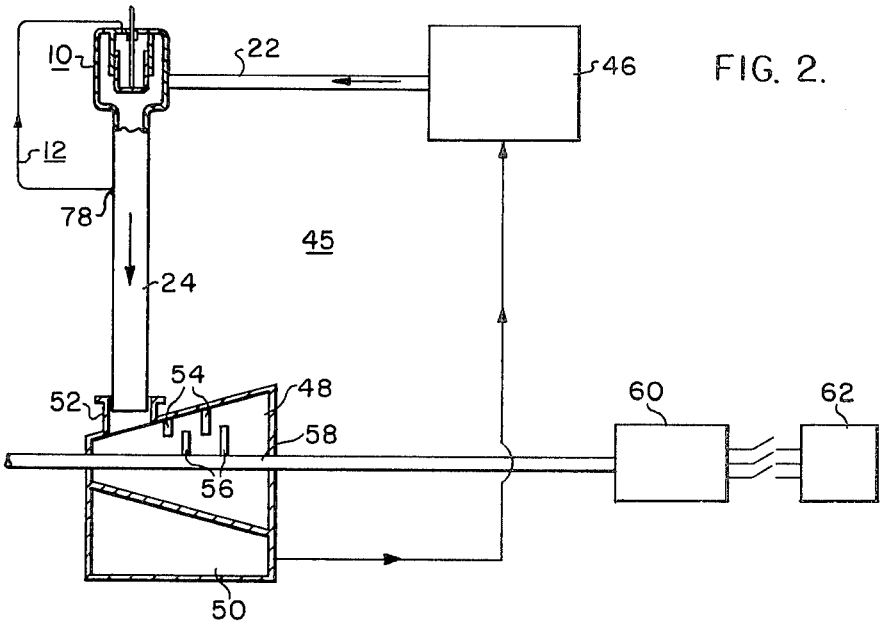
FIG. 2 is a diagrammatic view of a steam turbine power plant having the control valve disposed therein.

Referring to FIG. 2, a diagrammatic view of a steam turbine power plant 45 having the flow control apparatus 10 which embodies the teachings of the invention is shown. The power plant 45 comprises a series-connected closed-loop arrangement having at least a steam generator element 46 connected to a turbine element 48 and a condenser element 50. As seen in FIG. 2, the flow control apparatus 10 is connected to a steam generator 46 through the inlet conduit 22 and with the turbine 48 through the outlet conduit 24. Motive fluid, commonly high pressure, high temperature steam produced within the steam generator 46, is conducted into the flow control apparatus 10 by the inlet conduit 22. The fluid passes through the flow control apparatus 10 and is conducted through the outlet conduit 24 into an inlet 52 on the turbine 48. The motive fluid is permitted to expand through alternating arrays of stationary blades 54 and rotating blades 56 to convert the pressure energy of the steam into rotational mechanical energy of a shaft 58. After exhausting the turbine 48, the fluid flow is conducted from the condenser 50 back to the steam generator 46, to complete the closed-loop arrangement.

It is to be understood that the power plant 45 shown in FIG. 2 is a generalized version of a typical steam power generation facility and that the elements described above have functional equivalents that are found in both a nuclear or a fossile power generation station. As shown diagrammatically in FIG. 2, the turbine element 48 is connected by the common shaft 58 to a generator element 60, which converts the rotational mechanical energy of the shaft 58 into electrical energy to be utilized by an associated electrical load 62.

During low load conditions, such as off-peak hours of operation, it is desirable to reduce the mass flow rate of motive fluid passing from the steam generator element 46 to the turbine element 48. As is known to those skilled in the art, the mass flow rate may be controlled by varying either the area through which motive fluid enters the turbine or by changing the pressure of the fluid. If the turbine disposed in any particular power plant has a single admission arc therein, the area of fluid entry remains constant so that the only alternative available for reducing mass flow rate is to reduce the pressure of the fluid entering the turbine element. However, if there is disposed within the turbine element a plurality of admission arcs with each arc being separately connected to the steam generator and having a separate flow control apparatus associated therewith, both the area of fluid entry and the pressure of the fluid may be controlled. It is apparent however, that whatever the particular turbine inlet arrangement involved, effective control of the mass flow rate entering the turbine may be had by lowering the pressure of the fluid as it passes into the turbine inlet.

The flow control apparatus 10 may be utilized to lower the pressure of the fluid entering the turbine inlet by varying the position of the plug 28 relative to the valve seat 36. By modulating the clearance between the bottom of the valve plug 28 and the valve seat 36, or, as known to those skilled in the art, by varying the "lift", the pressure of the fluid entering the turbine inlet 52 (FIG. 2) is reduced below the pressure of the fluid at the inlet port 16 of the flow control apparatus.

Figure 3A:
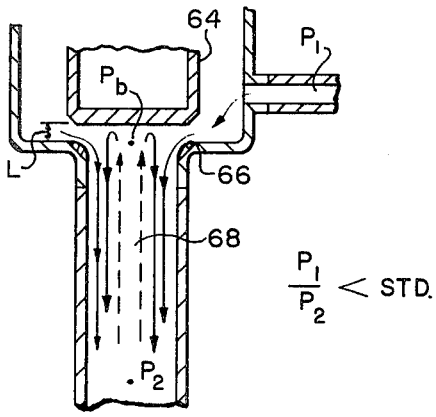
FIG. 3A. PRIOR ART
FIGS. 3A and 3B depicts the physical phenomena encountered in the prior art flow control devices which lead to the generation of excessive noise and vibration levels therein.
Figure 3B:
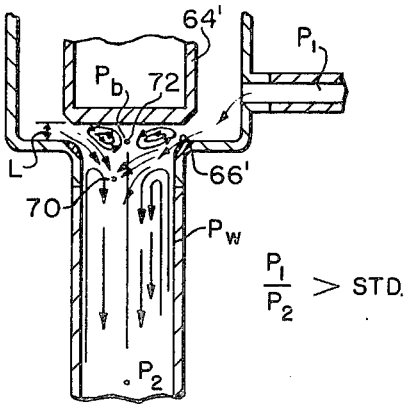
FIG. 3B. PRIOR ART

In the prior art is has been observed that flow control apparatus, such as control valving disposed between steam generator and turbine inlets, have experienced repeated vibration damage and encounter excessive noise levels. The apparent explanation for the vibration and excessive noise levels is that flow pulsating at the bottom of the valve plug causes the vibration and noise levels to occur. Referring to FIGS. 3A and 3B, diagrammatic views of the prior art flow control valves illustrating the phenomena causing excessive vibration and noise levels are shown.

In both FIGS. 3A and 3B, the lift "L" between the bottom of the valve plug 64 and its valve seat 66 is constant. Referring to FIG. 3A, during normal operation that is, when the ratio of valve inlet pressure P1 to turbine inlet pressure P2 is less than a certain predetermined standard the following physical conditions are extant: For the given lift and for a pressure ratio P1 to P2 being less than the predetermined standard, the flow stream lines pass from the valve chamber into the valve outlet substantially as shown in FIG. 3A. That is, the flow stream lines pass through the narrow channel between the valve plug and the valve seat and generally follow along the boundaries of the valve outlet conduits.

Empirical observations have shown that the pressure, Pb, at a point immediately below the bottom of the valve plug is less than the pressure $P_2$, the pressure of the fluid at the turbine inlet. It should be noted in this context that the pressure $P_2$ at the turbine inlet is substantially equal to the pressure within the outlet conduit approximately five pipe diameters downstream of the control valve. Thus for purposes of discussion, it will be assumed that the pressure $P_2$, which is the pressure of the fluid at the inlet of the turbine, is substantially equal to pressure existing in the conduit five pipe diameters downstream from the flow control device.

However, since the pressure $P_2$ is greater than the pressure at $P_b$ immediately downstream of the valve plug 64, a back flow of fluid occurs, the back flow being indicated by numeral 68, the back flow 68 moving relative to the piping from the downstream direction toward the valve plug. This natural back flow 68 from the higher static pressure region $P_2$ (approximately five pipe diameters below the flow control device) toward the lower pressure $P_b$ (immediately downstream of the plug of the flow control device) mixes with the high velocity inlet jet to dissipate its velocity head. Such viscose interaction dissipates the velocity energy of the fluid flow in an orderly manner and prevents excessive vibration and noise levels from occurring.

Referring now to FIG. 3B, the situation which occurs during low load conditions when the pressure ratio P1 to P2 is greater than the predetermined standard is depicted. In this situation, the fluid flow stream lines passing through the narrow channel between the bottom of the valve plug 64' and the valve seat 66' do not follow the boundaries of the outlet conduit but instead separate therefrom and collide beneath the valve plug, as illustrated by reference numeral 70 in FIG. 3B. The collision of the motive fluid stream lines adjacent the outlet port of prior art flow control devices creates a closed vortex cavity 72. As a result of the collision 70 of the influent main streams as shown in FIG. 3B, the natural back flow 68 (FIG. 3A) is greatly reduced. Thus, the viscose interaction which dissipated the velocity head as depicted in FIG. 3A is no longer adequate and dissipation occurs in large turbulent disturbances where the jets impinge. Further, this turbulent fluid trapped within the closed vortex cavity 72 causes vortex excitation to the exposed underside of the control valve plug 64' which induces excessive vibration to that valve plug. Also, high noise levels are thereby generated within the valve due to the collision 70 of the influent main streams.

Based on empirical observations of the situation extant in FIG. 3B, several general statements may be made about the pressure distribution therein shown. First of all, it is true that the pressure P1 adjacent the valve inlet of the flow control device is always greater than the static pressure $P_2$ which occurs several pipe diameters downstream of the flow control device. (The pressure $P_2$ is also substantially equal to the pressure at the turbine inlet.) It has also been observed that the static pressure, $P_b$, beneath the valve plug is less than the pressure $P_2$ downstream of the flow control device at low loads although the total pressure of the high velocity fluid is higher.

Capitalizing on the static pressure imbalance existing between the pressure P2 and the pressure $P_b$, and referring again to FIG. 1 and to FIG. 4, the noise and vibration suppression arrangement 12 generally indicated in FIG. 1 is explained in detail. Since, as described in connection with FIG. 3B, the natural back flow of fluid is restricted by the impinging jets 72, this invention provides an external conduit 76 to conduct fluid having pressure P2 therein into the closed vortex region 72 immediately beneath the valve plug 28.

A pressure tap 78 is provided at an appropriate place within the outlet conduit 24 where the static pressure P2 is available, such a location being approximately five pipe diameters downstream of the outlet port 36. The fluid having the pressure P2 is then conducted through the external conduit arrangement 76 into the opening 44 disposed in the valve cover. Thus, fluid having a total pressure P2 lower than P1 is conducted to the valve central cavity 38. This fluid P2 then passes through the openings 42 into the region immediately beneath the valve plug 28. Although there has been described the tap 78 being located five pipe diameters downstream of the plug 28, it is to be understood that the tap 78 may be disposed at any position on the outlet conduit wherein a pressure greater than the pressure P wall is extant. The pressure P wall is the pressure of the fluid along the walls of the conduit, as illustrated by the reference character $P_w$ in FIG. 3B.

The external conduit 76 enables a larger mass flow rate of fluid to pass from downstream of the plug 28 to immediately beneath the plug 28. The added mass flow increases the pressure $P_b$, which then literally forces the primary stream to flow along the conduit wall.

It may be readily appreciated that by providing, according to the teachings of this invention, an external conduit arrangement 76, an alternative path for the natural fluid back flow (FIG. 3A) is provided. Thus, the deleterious effects of the closed vortex cavity which generated the excessive noise and vibration levels in prior art valves during low load operation is effectively prevented.

It should be noted in this regard that any attempted solution which utilizes conduction of fluid having a pressure P1 therein, and utilizing that fluid to separate the colliding influent fluid flows and to viscously interact to dissipate the influent velocity head is unworkable. It is well known to those skilled in the art that since the purpose of the flow control device is control of mass flow to the turbine by restricting the flow area between the plug 64 and the seat 66, by passing flow around this restriction for mixing purposes would be counter to the main purpose of the valve. The invention described herein, using fluid which has conducted to this restricted area to effect separation of the colliding influent main streams and to dissipate the velocity head of the influent main streams as shown in FIG. 4, avoids this dilemma.

It can thus be seen that by providing at low loads an external recirculation path to conduct fluid from a region having a pressure (P2) greater than the pressure of the fluid beneath the valve plug ($P_b$), the pressure underneath the valve plug is increased. The increase in pressure underneath the valve plug separates the colliding fluid main streams to eliminate noise engendered thereby, and also permits viscous interaction of the influent fluid with the recirculated fluid to dissipate the velocity head of the influent main streams to limit vibratory forces on the valve plug.

I claim as my invention:

1. A flow control apparatus for modulating the pressure of a high velocity pressurized fluid passing therethrough comprising:

a casing having an inlet and an outlet port therein, a valve plug movably disposed within said casing, said valve plug having a cavity disposed therein, said plug having a bore extending therethrough, said cavity communicating with a region immediately beneath said valve plug through said bore, and, means for conducting into said plug cavity a fluid having a pressure therein higher than the pressure within a fluid flow in said region immediately beneath said valve plug, said fluid having said higher pressure passing from said plug cavity into said fluid flow in said region immediately beneath said valve plug to intermix with said fluid flow to dissipate the velocity thereof.

2. The flow control apparatus of claim 1; wherein:

said outlet port is connected to an outlet pipe, the pressure of the fluid within said outlet pipe at a predetermined location therein downstream of said valve plug being greater than the pressure within said fluid flow in said region immediately beneath said valve plug, and wherein said conducting means comprises a conduit, said conduit conducting fluid from within said outlet pipe at said predetermined location therein to said plug cavity.

3. The flow control apparatus of claim 2, wherein said predetermined location within said outlet pipe from which fluid is conducted by said conduit is located a distance of at least five outlet pipe diameters downstream from said valve plug.

4. The flow control apparatus of claim 2, wherein said conduit is mounted external to said valve casing.

5. In a steam turbine power plant having a steam generator element connected to a turbine element and providing motive fluid therefor, a flow control apparatus for modulating the pressure of said motive fluid disposed between said steam generator element and said turbine, said flow control apparatus comprising a casing having an inlet port connected to said steam generator, an outlet port connected to said turbine by an outlet pipe, a valve plug movably disposed within said casing, said plug having a cavity disposed therein and having a bore extending therethrough through which said cavity communicates with a region of said outlet pipe immediately beneath said valve plug, and wherein said improvement comprises means for conducting fluid into said plug cavity from a region having a pressure therein higher than the pressure of said motive fluid flow passing from said steam generator to said turbine benath said plug, said fluid conducted into said plug cavity passing through said bore into said motive fluid flow beneath said plug to intermix with said motive fluid flow to dissipate the velocity thereof.

6. The power plant of claim 5 wherein said motive fluid in said outlet pipe has a pressure at a predetermined location therein greater than the pressure of said motive fluid immediately beneath said valve plug, and wherein said conducting means comprises a conduit, said conduit communicating with said motive fluid at said predetermined location within said outlet pipe and conducting said motive fluid from said predetermined location to said plug cavity.

7. The power plant of claim 6, wherein said predetermined location of said outlet pipe from which fluid is conducted by said conduit is located at least five outlet pipe diameters downstream from said valve plug.

* * * * *